US007319373B2

(12) United States Patent
Zindler

(10) Patent No.: US 7,319,373 B2
(45) Date of Patent: Jan. 15, 2008

(54) ELECTRICAL SWITCHING APPARATUS AND TERMINAL HOUSING THEREFOR

(75) Inventor: Mark O. Zindler, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 52 days.

(21) Appl. No.: 11/337,330

(22) Filed: Jan. 23, 2006

(65) Prior Publication Data

US 2007/0171010 A1 Jul. 26, 2007

(51) Int. Cl.
*H01H 67/02* (2006.01)

(52) U.S. Cl. ..... 335/132; 335/202

(58) Field of Classification Search ..... 335/16, 335/17, 132
See application file for complete search history.

(56) References Cited

U.S. PATENT DOCUMENTS 2,601,484 A * 6/1952 Wood ..... 335/16
3,742,403 A * 6/1973 Nicol ..... 335/13
3,863,042 A * 1/1975 Nicol ..... 200/401
3,955,162 A * 5/1976 Nicol ..... 335/17
4,209,761 A * 6/1980 Klein et al. ..... 335/17
4,297,663 A * 10/1981 Seymour et al. ..... 335/20
4,400,670 A * 8/1983 Mostosi ..... 335/6
4,551,697 A * 11/1985 Kussy ..... 335/16
4,660,009 A * 4/1987 Wafer et al. ..... 335/6
4,679,019 A * 7/1987 Todaro et al. ..... 335/172
4,700,161 A * 10/1987 Todaro et al. ..... 335/172
4,801,906 A * 1/1989 Morris et al. ..... 335/17
4,831,221 A * 5/1989 Yu et al. ..... 200/553
4,849,590 A * 7/1989 Becker et al. ..... 218/33
4,912,439 A * 3/1990 Nagy et al. ..... 335/132
4,926,149 A * 5/1990 Saens et al. ..... 335/132
5,075,658 A * 12/1991 Lesslie et al. ..... 335/14
5,140,115 A * 8/1992 Morris ..... 200/308
5,172,088 A * 12/1992 Morgan ..... 335/201
5,381,121 A * 1/1995 Peter et al. ..... 335/20
5,466,903 A * 11/1995 Faber et al. ..... 200/400
5,539,168 A * 7/1996 Linzenich ..... 200/303
5,552,755 A * 9/1996 Fello et al. ..... 335/18
5,823,323 A * 10/1998 Seymour et al. ..... 200/308
5,831,500 A * 11/1998 Turner et al. ..... 335/17
5,836,441 A * 11/1998 Scheel et al. ..... 200/17 R
5,907,461 A * 5/1999 Hartzel et al. ..... 361/42

(Continued)

OTHER PUBLICATIONS

U.S. Appl. No. 11/254,514, filed Oct. 19, 2005, Zindler.

*Primary Examiner*—Elvin Enad
*Assistant Examiner*—Mohamad A Musleh
(74) *Attorney, Agent, or Firm*—Martin J. Moran

(57) ABSTRACT

An auxiliary switch terminal housing is provided for a telecommunication system circuit breaker including an enclosure, separable contacts inside the enclosure, line and load terminals in electrical communication with the separable contacts, an operating mechanism for opening and closing the separable contacts, and an auxiliary switch which is actuated by the operating mechanism. The auxiliary switch includes outputs and conductors electrically interconnected with the outputs. The terminal housing includes a first portion coupled to the enclosure of the circuit breaker proximate the line and load terminals, a second portion distal from the first portion, a plurality of terminals inside the second portion and electrically interconnected with the conductors and the outputs of the auxiliary switch, and a fastening mechanism, such as a pair of screws or rivets, fastening the terminal housing to the circuit breaker enclosure. An electrical switching apparatus employing a terminal housing is also disclosed.

20 Claims, 5 Drawing Sheets

U.S. PATENT DOCUMENTS 6,040,746 A * 3/2000 Maloney et al. ..... 335/13
6,137,385 A * 10/2000 Conway et al. ..... 335/202
6,217,370 B1 * 4/2001 Scheel et al. ..... 439/483
6,232,855 B1 * 5/2001 Malingowski et al. ..... 335/14
6,232,859 B1 * 5/2001 Christensen et al. ..... 335/132
6,239,395 B1 * 5/2001 Rosen ..... 200/559
6,366,188 B1 * 4/2002 Hein et al. ..... 335/202
6,377,144 B1 * 4/2002 Castonguay et al. ..... 335/202
6,392,512 B1 * 5/2002 Ferree et al. ..... 335/16
6,421,217 B1 * 7/2002 Castonguay et al. ..... 361/115
6,476,337 B2 * 11/2002 Castonguay et al. ..... 200/400
6,559,745 B2 * 5/2003 Yamagata et al. ..... 335/132
6,633,210 B1 10/2003 Fischer et al.
6,803,535 B1 * 10/2004 Whipple et al. ..... 200/308
6,806,800 B1 * 10/2004 Castonguay et al. ..... 335/68
6,864,447 B1 3/2005 Lipsey, II et al.
6,867,670 B2 * 3/2005 McCormick et al. ..... 335/6
6,882,258 B2 * 4/2005 Castonguay et al. ..... 335/132
6,903,636 B2 * 6/2005 Fischer ..... 335/13
7,023,303 B1 * 4/2006 Bogdon et al. ..... 335/6
7,064,636 B1 * 6/2006 Walz et al. ..... 335/18
7,135,945 B2 * 11/2006 Whipple et al. ..... 335/17
7,199,319 B1 * 4/2007 Rodgers et al. ..... 200/330
2004/0032702 A1 * 2/2004 Gibson et al. ..... 361/102
2004/0085167 A1 * 5/2004 McCormick et al. ..... 335/16
2007/0085642 A1 * 4/2007 Rodgers et al. ..... 335/172

* cited by examiner

ELECTRICAL SWITCHING APPARATUS AND TERMINAL HOUSING THEREFOR

CROSS-REFERENCE TO RELATED APPLICATION

This application is related to commonly assigned, concurrently filed:

U.S. patent application Ser. No. 11/337,331, filed Jan. 23, 2006, entitled "AUXILIARY SWITCH SUB-ASSEMBLY AND ELECTRICAL SWITCHING APPARATUS EMPLOYING THE SAME".

BACKGROUND OF THE INVENTION

1. Field of the Invention

The present invention relates generally to electrical switching apparatus and, more particularly, to electrical switching apparatus including a terminal housing. The invention further relates to terminal housings for electrical switching apparatus.

2. Background Information

Circuit breakers for telecommunication systems are small in comparison with circuit breakers commonly associated with power distribution networks. By way of example, in accordance with one conventionally known telecommunication system circuit breaker design, the circuit breaker measures about 2.5 inches high by about 2.0 inches long by about 0.75 inch thick, when viewed with the operating handle extending horizontally and moving in a vertical arc. While having a reduced size, the telecommunication system circuit breaker must still accommodate the various components (e.g., separable contacts; trip mechanism; operating mechanism) associated with larger circuit breakers.

Electrical switching apparatus, such as the aforementioned circuit breakers, as well as transfer switches, network protectors and the like, are often equipped with auxiliary switches that provide signals indicating certain conditions within the apparatus. For example, such auxiliary switches indicate whether the separable contacts are open or closed and/or whether the device has been tripped open. The signals generated by the switches can be used for communicating the condition to a remote location.

Auxiliary switches are either mechanically actuated, usually through physical contact with, or by a linkage to, the operating mechanism that opens and closes the separable contacts, or are of a non-contact variety being actuated by any known or suitable non-contact sensor (e.g., without limitation, Hall effect device; proximity sensor; optical sensor). However, some non-contact auxiliary switch designs are more complex thus undesirably increasing the complexity and associated cost of the circuit breaker.

The space constraints associated with small electrical switching apparatus pose a still further difficulty with respect to where and how to locate the terminals that receive signals from the auxiliary switch and the conductors which electrically connect such terminals to the auxiliary switch in order to output the signals. Specifically, although it is sometimes desirable to position the auxiliary switch terminals proximate the line and load terminals of the electrical switching apparatus, space at this location is extremely limited due to the small physical size of the apparatus. Moreover, telecommunication system circuit breakers, for example, are typically mounted in a relatively tight configuration within a multi-level rack where the small size and extended length of the circuit breakers make it difficult to reach behind the circuit breaker to install (i.e., electrically connect) it within the rack or other suitable enclosure.

Thus, there is a need for an improved auxiliary switch terminal arrangement for use with small electrical switching apparatus, such as telecommunication system circuit breakers.

There is, therefore, room for improvement in electrical switching apparatus including auxiliary switches, and in the arrangement of auxiliary switch conductors and terminals.

There is further room for improvement in circuit breakers, such as telecommunication system circuit breakers, having a reduced size but including an auxiliary switch disposed within the housing of the circuit breaker, and auxiliary switch terminals disposed proximate the line and load terminals of the circuit breaker.

SUMMARY OF THE INVENTION

These needs and others are met by the present invention, which is directed to an auxiliary switch terminal housing coupled to the electrical switching apparatus proximate the line and load terminals thereof.

As one aspect of the invention, an electrical switching apparatus comprises: a housing; separable contacts inside the housing; a line terminal; a load terminal, the line and load terminals being in electrical communication with the separable contacts; an operating mechanism structured to open and close the separable contacts; an auxiliary switch actuated by the operating mechanism, the auxiliary switch including a plurality of outputs; a plurality of conductors electrically interconnected with the outputs of the auxiliary switch; and an auxiliary switch terminal housing comprising: a first portion coupled to the housing of the electrical switching apparatus proximate the line and load terminals, a second portion distal from the first portion and including a plurality of terminals being electrically interconnected with the conductors and the outputs of the auxiliary switch, and a fastening mechanism fastening the auxiliary switch terminal housing to the housing of the electrical switching apparatus.

The first portion of the auxiliary switch terminal housing may include at least one aperture, and the fastening mechanism may include at least one fastener, wherein the at least one fastener is inserted through the at least one aperture and fastened in order to engage the housing of the electrical switching apparatus and to secure the auxiliary switch terminal housing thereto. The housing of the electrical switching apparatus may include opposing sides, and the first portion of the auxiliary switch terminal housing may include first and second sides engaging the opposing sides. The at least one aperture may comprise a first aperture in the first side of the first portion, and a second aperture in the second side of the first portion. The at least one fastener may comprise a pair of first and second fasteners selected from the group consisting of a rivet and a screw wherein the first and second fasteners are inserted through the first and second apertures, respectively.

The housing of the electrical switching apparatus may include a first side and a second side, and the first portion of the auxiliary switch terminal housing may comprise a first side and an opposing second side spaced from the first side of the auxiliary switch terminal housing, wherein the first and second sides of the auxiliary switch terminal housing engage the first and second sides of the housing of the electrical switching apparatus, respectively. At least one of the first and second sides of the auxiliary switch terminal housing may provide a passageway enclosing at least a portion of the conductors. The passageway may be disposed between the at least one of the first and second sides of the auxiliary switch terminal housing and a corresponding one of the first and second sides of the housing of the electrical switching apparatus.

The second portion of the auxiliary switch terminal housing may interconnect the first and second sides thereof. The first and second sides of the auxiliary switch terminal housing may extend from the second portion, and may be generally parallel with respect to one another in order to receive and engage a portion of the housing of the electrical switching apparatus therebetween. The portion of the housing being received between the first and second sides of the auxiliary switch terminal housing may include the line and load terminals of the electrical switching apparatus, in order that the line and load terminals of the electrical switching apparatus are generally disposed between the first and second sides of the auxiliary switch terminal housing. The housing of the electrical switching apparatus may include a mounting foot extending from the housing of the electrical switching apparatus between the line and load terminals, and the auxiliary switch terminal housing may couple to the housing of the electrical switching apparatus over the mounting foot.

The second portion of the auxiliary switch terminal housing may comprise a plug-in connector, wherein the plug-in connector includes as the terminals of the auxiliary switch terminal housing, a pair of terminals, and wherein the conductors comprise a pair of conductors electrically connected to the pair of terminals.

The auxiliary switch may be disposed within the housing of the electrical switching apparatus proximate the operating mechanism, and the housing of the electrical switching apparatus may further include an opening adjacent the auxiliary switch and a channel extending from the opening toward the line and load terminals. The conductors may extend from the auxiliary switch within the housing, through the opening out of the housing and into the channel, and through the channel into the auxiliary switch terminal housing. The housing may further include a cover covering the channel and the conductors disposed therein.

The electrical switching apparatus may be a telecommunication system circuit breaker, and the auxiliary switch terminal housing may comprise a plug-in adapter for the telecommunication system circuit breaker.

As another aspect of the invention, a terminal housing is provided for an electrical switching apparatus. The electrical switching apparatus includes an enclosure, separable contacts inside the enclosure, line and load terminals being in electrical communication with the separable contacts, an operating mechanism structured to open and close the separable contacts, and an auxiliary switch structured to be actuated by the operating mechanism. The auxiliary switch includes a plurality of outputs and a plurality of conductors electrically interconnected with the outputs. The terminal housing comprises: a first portion structured to be coupled to the enclosure of the electrical switching apparatus proximate the line and load terminals; a second portion distal from the first portion; a plurality of terminals inside the second portion and being structured to be electrically interconnected with the conductors and the outputs of the auxiliary switch; and a fastening mechanism structured to fasten the terminal housing to the enclosure of the electrical switching apparatus.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
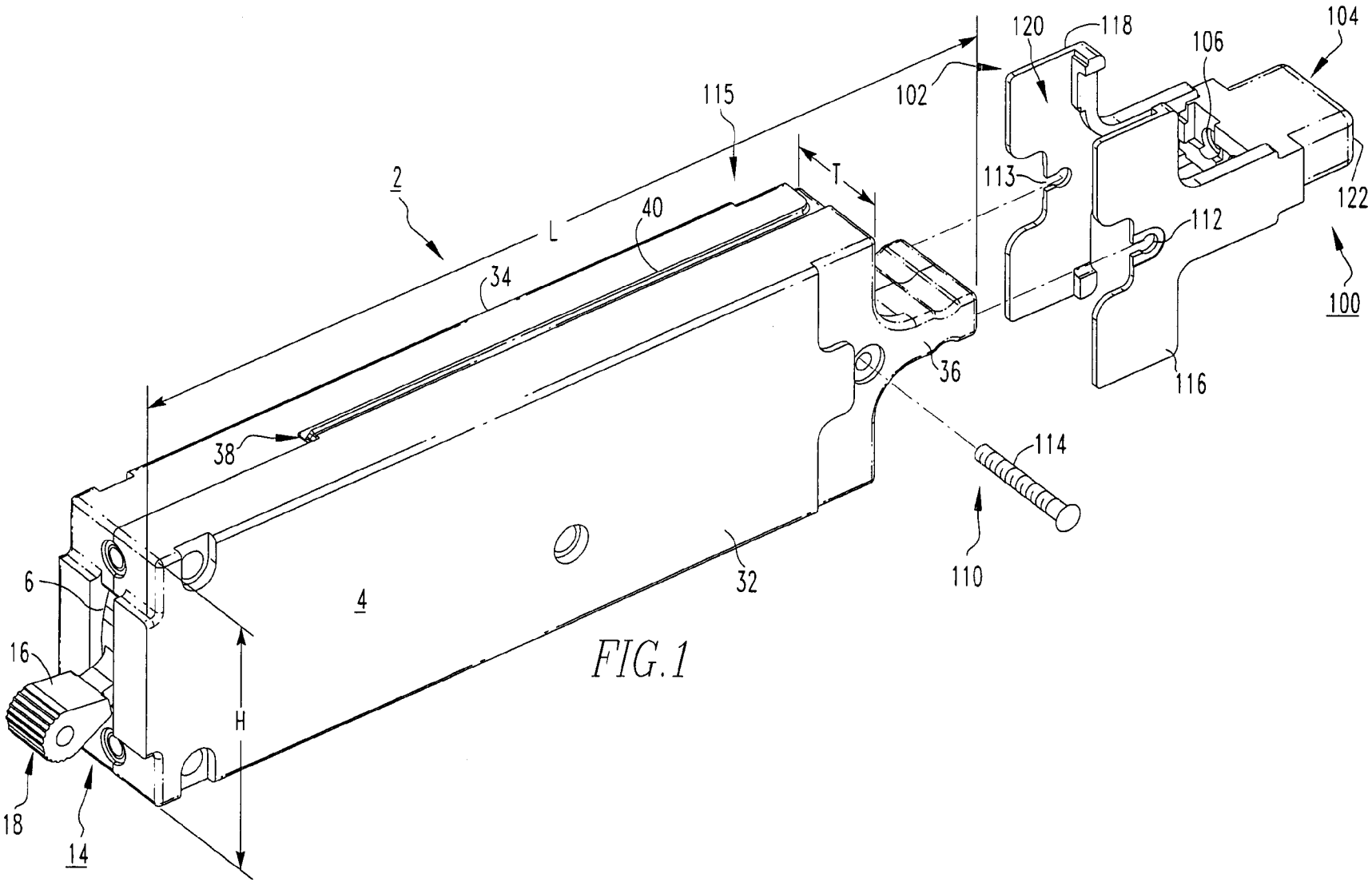
FIG. 1 is an exploded isometric view of a circuit breaker and a terminal housing therefor in accordance with the present invention.

For purposes of illustration, the invention will be described as applied to a telecommunication system circuit breaker, although it will become apparent that the invention could be applied to a variety of circuit breakers for a wide range of applications such as, for example and without limitation, residential or molded case circuit breakers.

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, rivets, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the statement that a part is "electrically interconnected with" one or more other parts shall mean that the parts are directly electrically connected together or are electrically connected together through one or more electrical conductors or generally electrically conductive intermediate parts. Further, as employed herein, the statement that a part is "electrically connected to" one or more other parts shall mean that the parts are directly electrically connected together or are electrically connected together through one or more electrical conductors.

As employed herein, the term "output" refers to any suitable mechanism for delivering an electrical signal, such as, for example and without limitation, the terminals of a micro-switch, which are outputs for delivering the signal generated in response to an actuation of the micro-switch.

As employed herein, the term "number" shall mean one or more than one (i.e., a plurality).

FIG. 1 shows an electrical switching apparatus 2 and terminal housing 100 therefor in accordance with one aspect of the present invention. In the example of FIG. 1, the electrical switching apparatus is a telecommunication circuit breaker 2 including an enclosure or housing 4 which has a length, represented by the letter "L," between about 5.0 and about 4.0 inches, and more preferably about 4.6 inches. The housing 4 also has a height, represented by the letter "H," of between about 1.75 inches and about 1.0 inch, and more preferably about 1.5 inches, and a thickness, represented by the letter "T," of between about 1.0 inch and about 0.5 inches, and more preferably about 0.75 inches. It will, however, be appreciated that the present invention is applicable to circuit breakers and other electrical switching apparatus having a wide variety of shapes and sizes.

Figure 2:
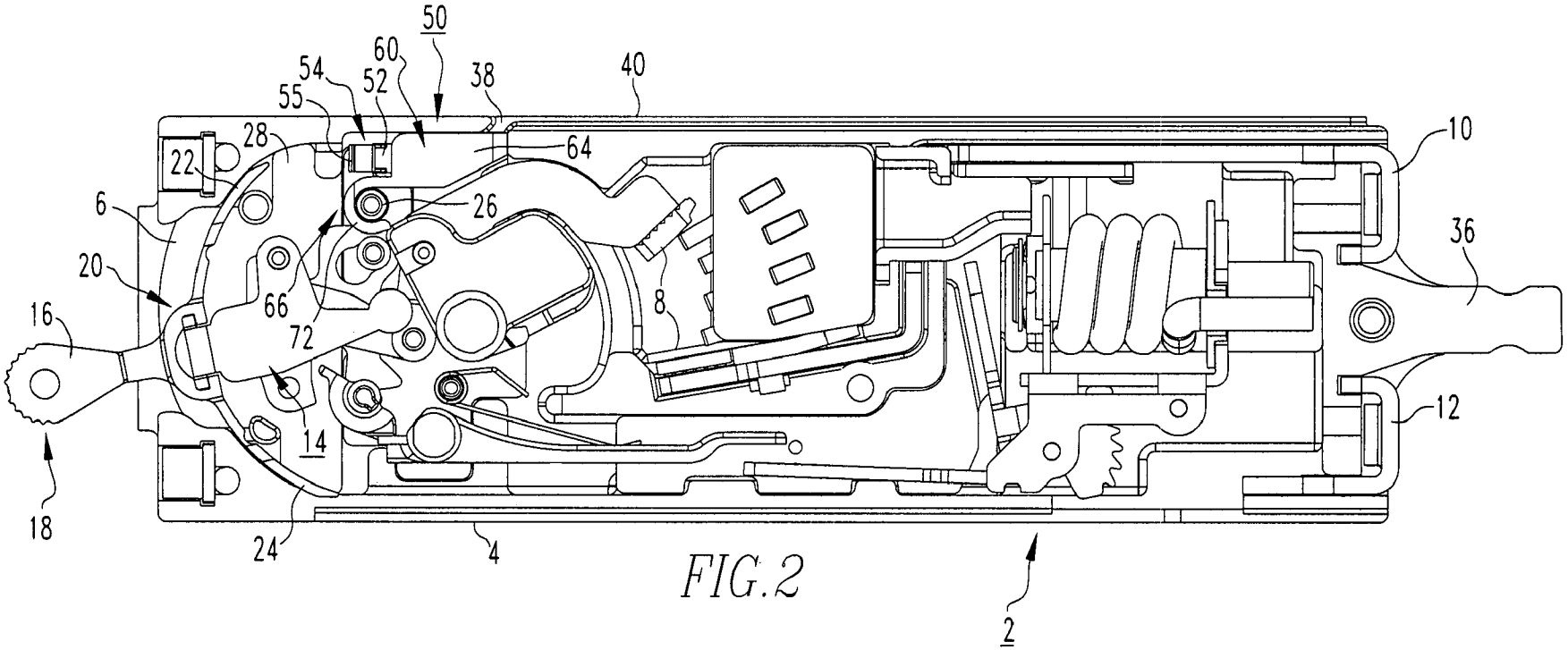
FIG. 2 is a side view of the circuit breaker of FIG. 1 with half of the circuit breaker housing removed to show internal structures including an auxiliary switch sub-assembly.
Figure 5:
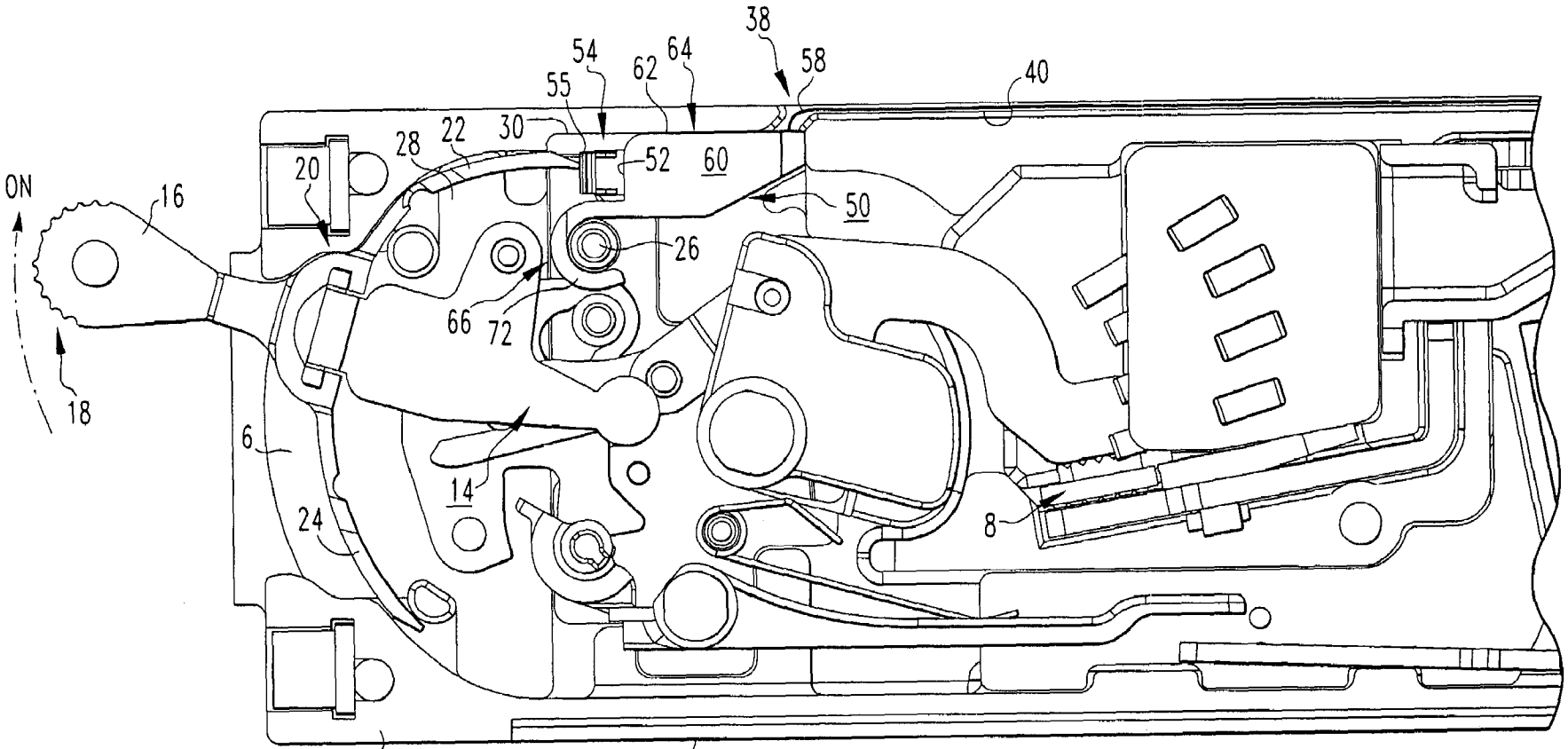
FIG. 5 is a side view of a portion of the circuit breaker and the auxiliary switch sub-assembly of FIG. 2 modified to show the circuit breaker operating handle in the ON position, thereby actuating the auxiliary switch.

Referring to FIGS. 1, 2 and 5, it will be appreciated that, in addition to housing 4 which has an opening 6, the circuit breaker 2 also includes separable contacts 8 (FIGS. 2 and 5) inside the housing 4, line and load terminals 10, 12 (FIG. 2) in electrical communication with the separable contacts 8, and an operating mechanism 14 structured to open and close the separable contacts 8 (FIGS. 2 and 5).

Figure 4:
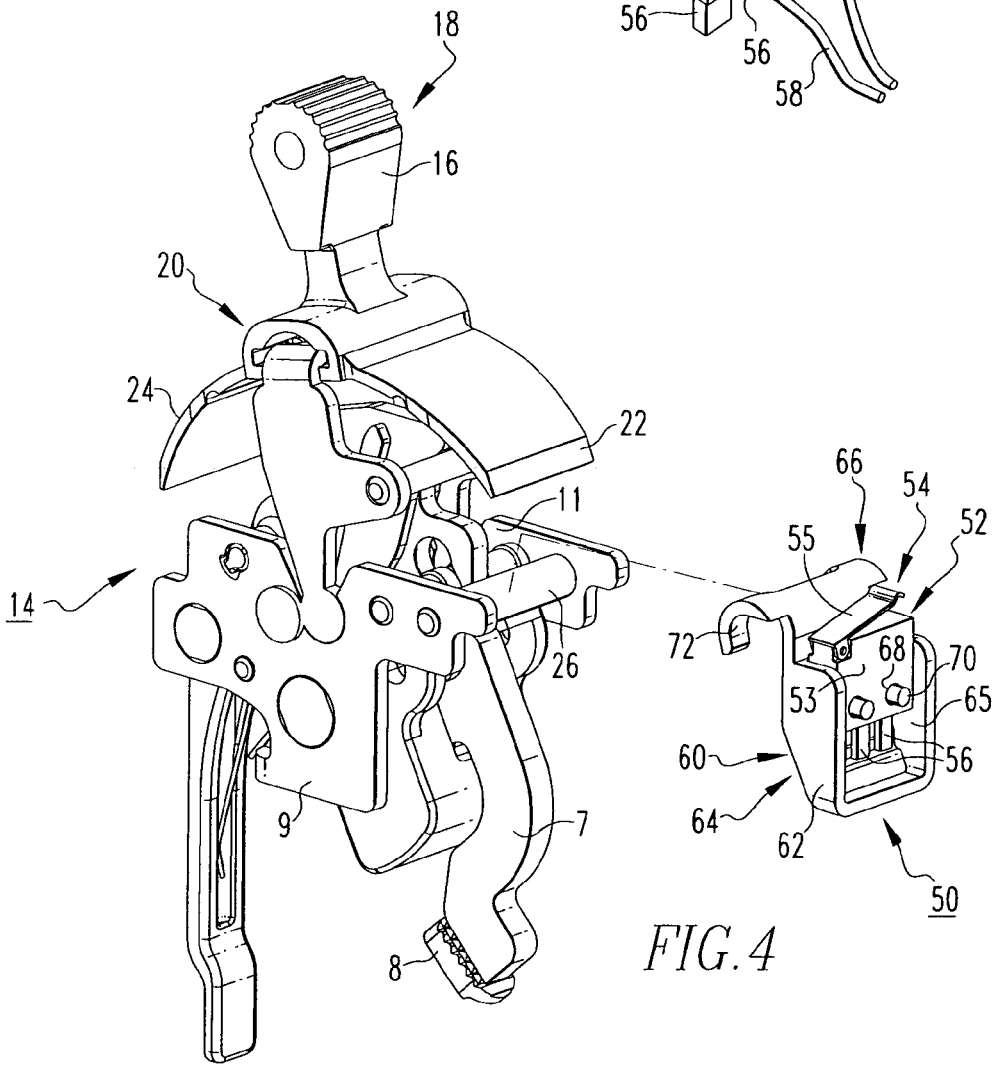
FIG. 4 is an exploded isometric view of the auxiliary switch sub-assembly and circuit breaker operating mechanism of FIG. 2.

The operating mechanism 14, as shown in FIGS. 2, 4 and 5, comprises an operating handle 16 operable among a first position (FIGS. 2 and 4) corresponding to the separable contacts 8 (only one of the contacts 8 (the movable contact) is shown in FIG. 4) being open, and a second position (FIG. 5) corresponding to the separable contacts 8 being closed. The operating handle 16 has a first end 18, which protrudes from the opening 6 of housing 4, and a second end 20 disposed within the housing 4, as shown in FIGS. 2 and 5. In the example shown and described herein, the second end 20 of operating handle 16 comprises a first resilient leg 22 and a second resilient leg 24. The first and second resilient legs 22, 24 extend in opposite directions within the opening 6 of housing 4. In this manner, the resilient legs 22, 24 resist undesired access to the interior 28 of the circuit breaker housing 4.

As best shown in FIG. 4, the operating mechanism 14 generally comprises a plurality of rigid members, including the movable arm 7 to which movable contact 8 is coupled. The rigid members (e.g., 7) interact with the second end 20 of operating handle 16 in order to open and close the separable contacts 8 upon movement of the operating handle 16 to the first open position and the second closed position, respectively. The rigid members are disposed between first and second side plates 9, 11 of the operating mechanism 14, as shown. At least one pin 26 extends between and interconnects the side plates 9, 11.

Referring to FIGS. 2-5, an auxiliary switch sub-assembly 50 will now be discussed. The auxiliary switch sub-assembly 50 includes an auxiliary switch 52 having an actuator 54, and a mount 60 structured to attach the auxiliary switch 52 to the operating mechanism 14 (not shown in FIG. 3) of the circuit breaker 2 (FIGS. 2 and 5). The mount 60 of the exemplary auxiliary switch sub-assembly 50 comprises a receiving portion 64 securably receiving the auxiliary switch 52, and an attachment portion 66, which comprises an integral hook 72 extending from the receiving portion 64 in order to attach the mount 60 to the pin 26 of the operating mechanism 14. In this manner, the auxiliary switch sub-assembly 50 of the invention is directly attached to the operating mechanism 14 of the circuit breaker 2. It will, however, be appreciated that any known or suitable alternative attachment mechanism and/or attachment portion configuration, other than the exemplary integral hook 72, could be employed to attach the mount 60 to the operating mechanism 14. It will further be appreciated that the mount 60 and auxiliary switch 52 coupled thereto could alternatively be attached to the operating mechanism 14 at a location other than pin 26. It will still further be appreciated that while the mount 60 of the auxiliary switch sub-assembly 50 is contemplated as comprising a single molded piece (best shown in FIG. 3), it could alternatively be made from a plurality of separate components joined together.

The receiving portion 64 of mount 60, in the example shown and described herein, comprises a molded receptacle 65 structured to receive the body 62 of the auxiliary switch 52. Additionally, the auxiliary switch body 62 has at least one opening 68, and the receiving portion 64 of the mount 60 includes at least one corresponding protrusion 70 received by the opening 68, in order to secure the auxiliary switch 52 to the mount 60. The exemplary body 62 includes a pair of first and second openings 68, and the receiving portion 64 of mount 60 comprises a pair of first and second posts 70 (best shown in the exploded view of FIG. 3), received by the first and second openings 68, respectively. The first and second posts 70 each further include a plurality of resilient ribs 74 structured to engage a corresponding one of the first and second openings 68 when the first and second posts 70 are respectively disposed therein. In this manner, the auxiliary switch 52 is further secured to mount 60. It will, however, be appreciated that any known or suitable alternative mechanism, other than the posts 70 and ribs 74, could be employed to receive and secure the auxiliary switch 52. Additionally, although the receiving portion 64 is contemplated as comprising a molded receptacle 65, the molded receptacle is not required, and other receiving portion configurations (not shown) could be alternatively employed.

The position of the mount 60 of auxiliary switch sub-assembly 50 and the auxiliary switch 52 coupled thereto, are further maintained by engagement of the mount 60 with the interior 28 of the circuit breaker housing 4, best shown in the example of FIG. 5. More specifically, the housing interior 28 includes a recess 30 corresponding to the mount 60. The mount 60 is partially disposed within the recess 30 thereby maintaining the mount's position with respect to the housing 4, as well as with respect to the operating mechanism 14. In this manner, the exemplary auxiliary switch sub-assembly 50 is mounted in a stationary position within the interior 28 of the circuit breaker housing 4. This permits the actuator 54 of the auxiliary switch 52 to be readily and consistently actuated by a portion of the second end 20 of operating handle 16. It will, however, be appreciated that engagement of the interior 28 by mount 60 is not required. It will further be appreciated that any suitable alternative engagement arrangement between mount 60 and housing 4 could be employed. Operation of the auxiliary switch 52 will now be described.

Generally, when the operating handle 16 is moved to a predetermined one of the first and second positions, as previously described, a portion of the second end 20 of the operating handle 16 mechanically engages and actuates the actuator 54 of auxiliary switch 52. More specifically, the second end 20 of the operating handle 16 includes the aforementioned first and second resilient legs 22, 24, and the portion of the second end 20 of operating handle 16 which engages and actuates the actuator 54 of auxiliary switch 52, is the first resilient leg 22. Accordingly, as shown in FIG. 5, when the operating handle 16 is moved to the second position (i.e., pivoted clockwise with respect to FIG. 5), which corresponds to the ON position of the circuit breaker 2 in which the separable contacts 8 are closed, the first resilient leg 22 engages and actuates actuator 54 of the auxiliary switch 52. Accordingly, the auxiliary switch 52 has a non-actuated position, shown in FIGS. 2-4, and the actuated position of FIG. 5. In the example shown and described herein, the actuator 54 comprises a lever 55 which is pivotably coupled to the housing 53 of the auxiliary switch 52. The first resilient leg 22 engages and actuates (i.e., pivots downward with respect to FIG. 3) the lever 55 when the operating handle 16 is disposed in the second, ON position of FIG. 5. It will, however, be appreciated that any known or suitable auxiliary switch and actuator therefor, could be employed.

The aforementioned auxiliary switch terminal housing 100, which can be readily employed with any known or suitable auxiliary switch, including the auxiliary switch sub-assembly 50 described hereinabove, will now be described in further detail.

Figure 3:
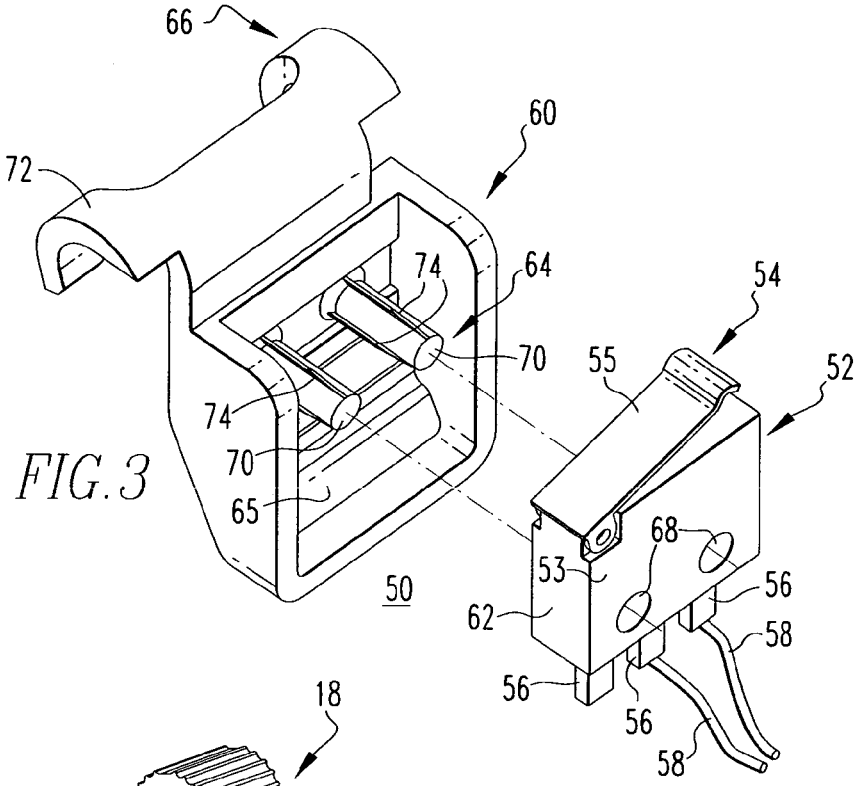
FIG. 3 is an exploded isometric view of the auxiliary switch sub-assembly of FIG. 2.
Figure 6:
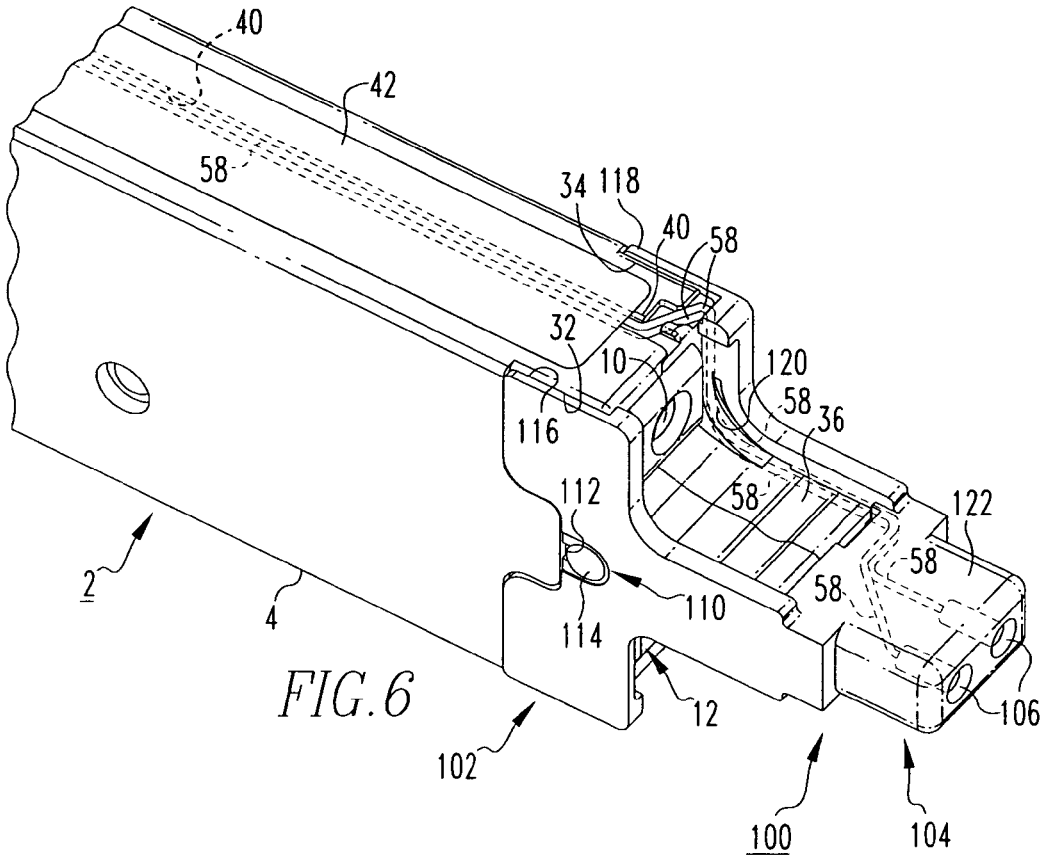
FIG. 6 is an assembled isometric view of a portion of the circuit breaker and the terminal housing of FIG. 1.

Specifically, as shown in FIG. 3, the auxiliary switch 52 includes a plurality of outputs 56 (three outputs 56 are shown in FIG. 3, a pair of outer outputs corresponding to the auxiliary switch being normally open and normally closed, respectively, and a central common output disposed therebetween), and a plurality of conductors 58 (e.g., without limitation, electrical wires) which are electrically interconnected with the outputs 56. In FIG. 3, a pair of conductors 58 are electrically connected at their first ends to the central common output 56 and one of the normally open and normally closed outputs 56 of the auxiliary switch 52. The opposite ends are electrically connected to a pair of terminals 106 in the terminal housing 100, as shown in hidden line drawing in FIG. 6. More specifically, referring to FIGS. 1, 2 and 5, the circuit breaker housing 4 further includes an opening 38 adjacent the auxiliary switch 52 which is disposed therein, and a channel 40 extends from the opening 38 toward the line and load terminals 10, 12 (FIGS. 2 and 6). The conductors 58 extend from the auxiliary switch 52 (FIG. 3) within the housing 4, through the opening 38 and into the channel 40, as shown in FIG. 5, and through the channel 40 into the auxiliary switch terminal housing 100, as shown in FIG. 6. The housing 4 of the circuit breaker 2 optionally further includes a cover 42 which substantially covers the channel 40 and conductors 58 disposed therein, as shown in FIG. 6. It will also be appreciated that the conductors 58 could alternatively be routed in any suitable manner within the housing 4, internally (not shown).

The auxiliary switch terminal housing 100 includes a first portion 102 structured to be coupled to the circuit breaker housing 4 proximate the line and load terminals 10, 12, thereof, and a second portion 104 distal from the first portion 102 and including terminals 106. A fastening mechanism 110 is structured to fasten the terminal housing 100 to the circuit breaker 2, as shown in FIGS. 1 and 6. Specifically, the first portion 102 of the terminal housing 100 includes at least one aperture 112, 113, and the fastening mechanism 110 includes at least one fastener 114, 115 (FIG. 1). In the example shown and described herein, the circuit breaker 2 includes first and second sides 32, 34 (FIGS. 1 and 6), the first portion 102 of the terminal housing 100 includes first and second sides 116, 118 structured to engage the first and second opposing sides 32, 34, and the at least one aperture 112, 113 comprises a first aperture 112 in the first side 116 of the first portion 102, and a second aperture 113 in the second side 118 of first portion 102. A pair of first and second fasteners such as, for example and without limitation, the rivets 114, 115 (shown in FIG. 1; one rivet 114 is also shown in FIG. 6), are inserted through the first and second apertures 112, 113, respectively, and fastened to secure the terminal housing 100 to the circuit breaker 2. In this manner, the first and second sides 116, 118 of terminal housing 100 are spaced apart from one another in order that the line and load terminals 10, 12 of circuit breaker 2 are generally disposed therebetween.

The second portion 104 of the terminal housing 100 interconnects the first and second sides 116, 118 of the first portion 102 of the terminal housing 100. Thus, the first and second sides 116, 118 of first portion 102 extend from the second portion 104 and are generally parallel with respect to one another, as shown, for example in FIG. 6. Accordingly, when the auxiliary switch terminal housing 100 is coupled to the circuit breaker housing 4, the mounting foot 36, which extends from the circuit breaker housing 4 between the line and load terminals 10, 12 thereof, is generally disposed within the auxiliary switch terminal housing 100 between the first and second sides 116, 118 thereof (best shown in FIG. 6).

Figure 7:
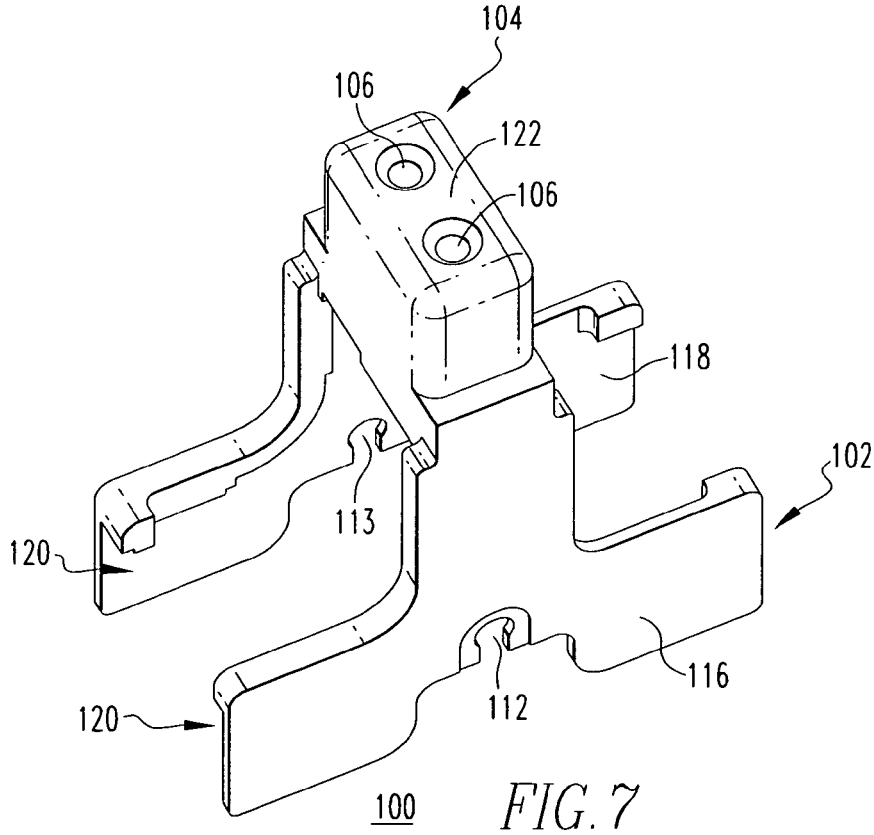
FIG. 7 is an isometric view of the terminal housing of FIG. 1.

Continuing to refer to FIG. 6, it will be appreciated that the aforementioned arrangement provides a passageway 120 between at least one of the first and second sides 116, 118 of the terminal housing 100 and the corresponding one of the first and second sides 32, 34 of the circuit breaker housing 4. As shown, the passageway 120 receives and protects the conductors or electrical wires 58 (partially shown in hidden line drawing in FIG. 6) as they extend from the channel 40 and between mounting foot 36 and second side 118 toward their electrical interconnection with terminals 106. The exemplary second portion 104 comprises a plug-in connector 122 which is structured to readily electrically interconnect with a corresponding connector (not shown) of a wide variety of known or suitable electrical apparatus (not shown). It will be appreciated that although the plug-in connector 122 shown in the examples of FIGS. 1, 6 and 7 is a male connector having two terminals 106, that any known or suitable alternative connector configuration (e.g., without limitation, a female connector (not shown)) having any suitable number of terminals, could be alternatively employed without departing from the scope of the present invention. It will further be appreciated that any suitable number and type of conductors, other than the pair of electrical wires 58 shown, could be employed and routed from the auxiliary switch 52 (FIGS. 3 and 5) to the terminals (e.g., 106) of the auxiliary switch terminal housing 100, in any suitable manner. For example and without limitation, the electrical wires 58 could diverge (not shown) at the exit of the channel 40 in order that first and second wires are disposed in first and second separate passageways (only first passageway 120 is shown in FIG. 6) on opposite sides, respectively, of the mounting foot 36 of circuit breaker 2.

Accordingly, the present invention provides an auxiliary switch terminal housing 100 for locating the auxiliary switch terminals 106 proximate the line and load terminals 10, 12 of small electrical switching apparatus, such as, for example and without limitation, telecommunication system circuit breakers 2, despite the small size of the circuit breaker 2. The invention thereby provides a mechanism for blindly interfacing with a variety of electrical apparatus at the back of the circuit breaker 2, which is difficult to reach. Hence, the present invention provides a useful accessory which, among other advantages, allows replacement of the auxiliary switch terminals 106 without requiring replacement of the entire circuit breaker 2.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a housing including a first end, a second end disposed opposite and distal from the first end, and a length;

separable contacts inside said housing;

a line terminal disposed at or about the second end of said housing;

a load terminal disposed at or about the second end of said housing, said line and load terminals being in electrical communication with said separable contacts;

an operating mechanism structured to open and close said separable contacts;

an auxiliary switch structured to respond to said operating mechanism, said auxiliary switch including a plurality of outputs;

a plurality of conductors electrically interconnected with the outputs of said auxiliary switch; and an auxiliary switch terminal housing comprising:

a first portion coupled to the second end of said housing of said electrical switching apparatus proximate said line and load terminals, thereby extending the length of said housing of said electrical switching apparatus, a second portion distal from said first portion and including a plurality of terminals being electrically interconnected with said conductors and the outputs of said auxiliary switch, and a fastening mechanism fastening said auxiliary switch terminal housing to said housing of said electrical switching apparatus.

2. The electrical switching apparatus of claim 1 wherein the first portion of said auxiliary switch terminal housing includes at least one aperture; wherein said fastening mechanism includes at least one fastener; and wherein said at least one fastener is inserted through said at least one aperture and fastened in order to engage said housing of said electrical switching apparatus and to secure said auxiliary switch terminal housing thereto.

3. The electrical switching apparatus of claim 2 wherein said housing of said electrical switching apparatus includes opposing sides; wherein the first portion of said auxiliary switch terminal housing includes first and second sides engaging said opposing sides; wherein said at least one aperture comprises a first aperture in the first side of the first portion, and a second aperture in the second side of the first portion; wherein said at least one fastener comprises a pair of first and second fasteners selected from the group consisting of a rivet and a screw; and wherein said first and second fasteners are inserted through said first and second apertures, respectively.

4. The electrical switching apparatus of claim 1 wherein said housing of said electrical switching apparatus includes a first side and a second side; wherein the first portion of said auxiliary switch terminal housing comprises a first side and an opposing second side spaced from the first side of said auxiliary switch terminal housing; and wherein the first and second sides of said auxiliary switch terminal housing engage the first and second sides of said housing of said electrical switching apparatus, respectively.

5. The electrical switching apparatus of claim 4 wherein at least one of the first and second sides of said auxiliary switch terminal housing provides a passageway enclosing at least a portion of said conductors; and wherein said passageway is disposed between said at least one of the first and second sides of said auxiliary switch terminal housing and a corresponding one of the first and second sides of said housing of said electrical switching apparatus.

6. The electrical switching apparatus of claim 4 wherein the second portion of said auxiliary switch terminal housing interconnects the first and second sides thereof; and wherein the first and second sides of said auxiliary switch terminal housing extend from the second portion and are generally parallel with respect to one another in order to receive and engage a portion of said housing of said electrical switching apparatus therebetween.

7. The electrical switching apparatus of claim 6 wherein the portion of said housing of said electrical switching apparatus being received between the first and second sides of the auxiliary switch terminal housing includes said line and load terminals of said electrical switching apparatus, in order that said line and load terminals of said electrical switching apparatus are generally disposed between the first and second sides of said auxiliary switch terminal housing.

8. The electrical switching apparatus of claim 1 wherein the second portion of said auxiliary switch terminal housing comprises a plug-in connector; wherein said plug-in connector includes as said terminals of said auxiliary switch terminal housing, a pair of terminals; and wherein said conductors comprise a pair of conductors electrically connected to said pair of terminals.

9. The electrical switching apparatus of claim 1 wherein said housing of said electrical switching apparatus includes a mounting foot extending from said housing of said electrical switching apparatus between said line and load terminals; and wherein said auxiliary switch terminal housing couples to said housing of said electrical switching apparatus over said mounting foot.

10. The electrical switching apparatus of claim 1 wherein said auxiliary switch is disposed within said housing of said electrical switching apparatus proximate said operating mechanism; wherein said housing of said electrical switching apparatus further includes an opening adjacent said auxiliary switch, and a channel extending from said opening toward said line and load terminals; and wherein said conductors extend from said auxiliary switch within said housing, through said opening out of said housing and into said channel, and through said channel into said auxiliary switch terminal housing.

11. The electrical switching apparatus of claim 10 wherein said housing further includes a cover covering said channel and said conductors disposed therein.

12. The electrical switching apparatus of claim 1 wherein said electrical switching apparatus is a telecommunication system circuit breaker; and wherein said auxiliary switch terminal housing comprises a plug-in adapter for said telecommunication system circuit breaker.

13. A terminal housing for an electrical switching apparatus including an enclosure, separable contacts inside said enclosure, line and load terminals being in electrical communication with said separable contacts, an operating mechanism structured to open and close said separable contacts, and an auxiliary switch structured to respond to said operating mechanism, said enclosure having a first end, a second end disposed opposite and distal from the first end, and a length, said line and load terminals being disposed at or about the second end of said enclosure, said auxiliary switch including a plurality of outputs and a plurality of conductors electrically interconnected with the outputs, said terminal housing comprising:

a first portion structured to be coupled to the second end of said enclosure of said electrical switching apparatus proximate said line and load terminals, thereby extending the length of said enclosure;

a second portion distal from said first portion;

a plurality of terminals inside the second portion and being structured to be electrically interconnected with said conductors and the outputs of said auxiliary switch; and a fastening mechanism structured to fasten said terminal housing to said enclosure of said electrical switching apparatus.

14. The terminal housing of claim 13 wherein the first portion of said terminal housing includes at least one aperture; wherein said fastening mechanism includes at least one fastener; and wherein said at least one fastener is inserted through said at least one aperture and fastened in order to engage said enclosure of said electrical switching apparatus and to secure said terminal housing thereto.

15. The terminal housing of claim 14 wherein said enclosure of said electrical switching apparatus includes opposing sides; wherein the first portion of said terminal housing includes first and second sides structured to engage said opposite sides; wherein said at least one aperture comprises a first aperture in the first side of the first portion and a second aperture in the second side of the first portion; wherein said at least one fastener comprises a pair of first and second fasteners selected from the group consisting of a rivet and a screw; and wherein said first and second fasteners are inserted through said first and second apertures, respectively.

16. The terminal housing of claim 13 wherein said enclosure of said electrical switching apparatus includes a first side and a second side; wherein the first portion of said terminal housing comprises a first side and an opposing second side spaced from the first side of said terminal housing; and wherein the first and second sides of the first portion of said terminal housing are structured to engage the first and second sides of said enclosure of said electrical switching apparatus, respectively.

17. The terminal housing of claim 16 wherein at least one of the first and second sides of the first portion of said terminal housing is structured to provide a passageway enclosing at least a portion of said conductors; and wherein said passageway is disposed between said at least one of the first and second sides of said terminal housing and a corresponding one of the first and second sides of said enclosure of said electrical switching apparatus.

18. The terminal housing of claim 16 wherein the second portion of said terminal housing interconnects the first and second sides of the first portion of said terminal housing; and wherein the first and second sides of the first portion extend from the second portion and are generally parallel with respect to one another in order to receive and engage a portion of said enclosure of said electrical switching apparatus therebetween.

19. The terminal housing of claim 13 wherein the second portion of said terminal housing comprises a plug-in connector; wherein said plug-in connector includes as said terminals of said terminal housing a pair of terminals; wherein said auxiliary switch includes as said conductors a pair of conductors; and wherein said pair of terminals are structured to be electrically interconnected with said pair of conductors.

20. The terminal housing of claim 16 wherein the first side of said housing of said electrical switching apparatus includes a first recess disposed at or about the second end of said housing of said electrical switching apparatus; wherein the second side of said housing of said electrical switching apparatus includes a second recess disposed at or about the second end of said housing of said electrical switching apparatus; wherein the first side of said terminal housing is disposed in said first recess; and wherein the second side of said terminal housing is disposed in said second recess.

* * * * *